US006944966B2

(12) United States Patent
Winheim

(10) Patent No.: US 6,944,966 B2
(45) Date of Patent: Sep. 20, 2005

(54) STEAM BLOWER BOX

(75) Inventor: Stefan Winheim, Frankfurt am Main (DE)

(73) Assignee: V.I.B. Systems GmbH, Maintal (DE)

( * ) Notice: Subject to any disclaimer, the term of this patent is extended or adjusted under 35 U.S.C. 154(b) by 0 days.

(21) Appl. No.: 10/988,210

(22) Filed: Nov. 12, 2004

(65) Prior Publication Data

US 2005/0108894 A1 May 26, 2005

(30) Foreign Application Priority Data

Nov. 13, 2003 (DE) ..... 103 52 980

(51) Int. Cl.[7] ..... F26B 3/00
(52) U.S. Cl. ..... 34/114; 34/119; 34/124
(58) Field of Search ..... 34/114, 115, 116, 34/117, 119, 124, 618; 162/206, 207

(56) References Cited

U.S. PATENT DOCUMENTS

| | | | | |
|---|---|---|---|---|
| 3,011,544 A | * | 12/1961 | Lippke | 162/289 |
| 3,208,158 A | * | 9/1965 | Smith, Jr. | 34/122 |
| 3,467,541 A | | 9/1969 | Aronson et al. | |
| 4,915,788 A | | 4/1990 | Winheim | |
| 5,752,324 A | | 5/1998 | Muller et al. | |
| 5,799,411 A | | 9/1998 | Schiel | |
| 5,933,981 A | * | 8/1999 | Meschenmoser | 34/456 |
| 6,449,874 B2 | * | 9/2002 | Pellinen | 34/452 |
| 2004/0011492 A1 | | 1/2004 | Grabscheid et al. | |

FOREIGN PATENT DOCUMENTS

| | | |
|---|---|---|
| DE | 1 964 194 | 4/1973 |
| DE | 43 09 076 | 9/1994 |
| DE | 101 54 828 | 5/2003 |
| DE | 203 19 797 | 5/2004 |
| EP | 1 143 067 | 10/2001 |

* cited by examiner

*Primary Examiner*—Stephen Gravini
(74) *Attorney, Agent, or Firm*—Friedrich Kueffner

(57) ABSTRACT

A steam blower box for the application of steam on a material web, particularly paper, which travels past the steam blower box includes a housing wall which faces the material web and extends transversely of the web travel direction. A plurality of steam outlet openings are arranged in the housing wall. The steam outlet openings are arranged in at least two separate groups, wherein at least one section which is free of steam application is provided between two adjacent groups, and wherein the air entrained by the material web is discharged through this section.

15 Claims, 4 Drawing Sheets

STEAM BLOWER BOX

BACKGROUND OF THE INVENTION

1. Field of the Invention

The present invention relates to a steam blower box for the application of steam on a material web, particularly paper, which travels past the steam blower box. The steam blower box includes a housing wall which faces the material web and extends transversely of the web travel direction, wherein a plurality of steam outlet openings are arranged in the housing wall.

2. Description of the Related Art

In the manufacture of paper or the further processing of paper, steam is frequently admitted to the running web. There are various reasons for this application of steam. However, the object is always to condensate the steam emitted from the steam blower box as precisely as possible on or in a certain area of the web, and to transfer heat and/or moisture to the web in this manner. Differing quantities of condensation transversely of the web make it possible to influence certain properties, such as gloss, smoothness, etc., in a targeted manner and to achieve a profiling of the web or the elimination of undesired differences of these properties across the web.

However, a maximum efficiency of the steam application is only achieved under ideal conditions, i.e., if no additional heat transfer resistance between the steam and the web is present. This ideal condition is practically never achieved. Contrary to heat exchangers or boilers, the heat transfer resistance plays no role in a running web as a result of the condensate film which is created because this condensate film is continuously moved together with the web out of the steam application area. However, the steam application space at a running web is normally not only filled with steam. Because of friction, an air film is continuously conveyed together with the web into the steam application area. An energy exchange takes place between this air and the steam. A portion of the steam condenses in the air instead of at the web and, therefore, can no longer contribute to the desired heating and moisture enrichment of the web. In addition, the air which is heated and enriched with water becomes oversaturated during cooling and precipitates water droplets. The resulting water vapors negatively affect the climate within the work area and results in the formation of droplets at machine components. Accordingly, the principal disadvantage of the presence of air is the reduced efficiency of the steam application. Since the air film screens portions of the web from direct contact with the steam, generally only a portion of the web comes into a direct heat exchange within the steam application area.

In order to overcome this disadvantage, so-called high-speed steam blower boxes have already been proposed. In these high-speed steam blower boxes, the steam jets are emitted with such a high speed that the air is displaced from the web surface at the points of impingement of the steam on the web, and a direct contact occurs between the steam and the web. For this purpose, the impinging steam jet must produce an appropriate blocking pressure depending on the web speed. At high web speeds and with acceptably large outlet openings, the necessary blocking pressure is achieved with the emitted steam only when steam quantities are applied which usually exceed the absorption capability of the web. Consequently, in the case of relatively low steam requirements, for example, when applying steam on paper webs for increasing the smoothness at calendars, it is necessary to operate with a steam excess which is much too large, in order to approach the desired condition. Also, it is frequently necessary to suction off this excess steam, wherein a high suction power is required, on the one hand, and, on the other hand, there is the danger that an unintentional suctioning off of steam portions will reduce the efficiency of the steam application.

DE 37 01 406 C2 discloses special sealing zones which have the purpose of using the direction of the steam jets for achieving a blocking effect on both sides of the steam application area. It is intentionally accepted air that is suctioned off because of the injection effect of the steam jets and the air is utilized for the sealing effect. A separation of air and steam area does not take place.

DE 44 01 220 C1 describes a steam blower box in which a sectionally different steam application can be utilized for influencing the transverse moisture profile of the material web. The sectional zone chambers used for this purpose are connected through a separate steam line and a control valve each to the steam distributor. The common steam outlet panel has several rows of blower openings. These rows of blower openings are arranged in the steam outlet panel completely inclined relative to the travel direction of the material web. The steam is directed in a direction opposite the material running direction. This steam blower box makes it possible to apply steam block by block transversely of the travel direction of the material web.

SUMMARY OF THE INVENTION

It is the object of the present invention to provide a steam blower box in which the steam application area is kept essentially free of air.

In accordance with the present invention, in a steam blower box of the above-described type, the steam outlet openings are arranged in at least two separate groups, wherein at least one section which is free of steam application is provided between two adjacent groups, and wherein the air entrained by the material web is discharged through this section.

By arranging the steam outlet openings in offset blocks in the housing wall constructed, for example, as a perforated profile plate, the entrained air is conducted past the steam application areas. Similar to the effect of a tire profile on a wet surface, the air is marginally pushed to the side so that the steam can condensate in the steam application area directly and, thus, with a higher efficiency on or in the material web. The section which is free of steam application between the adjacent steam outlet openings groups acts like a channel which conducts the air past the steam application areas.

In accordance with a preferred development of the invention, the upstream and/or downstream end in web travel direction of a group of steam outlet openings located next to each other extends inclined relative to the web travel direction. The inclined orientation of the steam outlet openings reduces the angle of impingement of the air on the steam application area. The change of direction of the air required for deflection is small, and the air can be deflected easily, uniformly and effectively.

In accordance with the invention, the front and/or rear side of the group is at least partially inclined relative to the web travel direction at an angle $\alpha$ in the range of 30–60°, preferably 45°. In that case, the air flow impinges at this angle $\alpha$ on the steam flow emerging from the steam outlet openings. The dynamic or impact pressure of the air is reduced proportionally to tan $\alpha$ because the retained air can freely flow off laterally of the web direction. This is achieved particularly if the inclination of the front edge of the steam application area is so large that the rearward end of the front steam application border of a steam application area in the web direction still is located significantly behind the front end of the rear steam application border of the adjacent steam application area.

The desired influence on the flow conditions in the steam application area can be realized particularly easily if, in accordance with the present invention, each group essentially has the shape of an arrow or a parallelogram. In the latter case, two of the four sides of a group of steam outlet openings arranged adjacent to each other extend parallel to the web travel direction, so that no deflection occurs in this area.

In accordance with a preferred embodiment, adjacent groups are arranged offset relative to each other in the web travel direction so that the air flow is deflected in several stages. This produces steam application areas and areas which are free of steam application at one location transversely of the web. Steam is applied further back in the web direction to the areas which were previously free of steam application.

In order to ensure simultaneous and uniform deflection over the entire width of the steam blower box, preferably every second group is arranged on the same level in the web travel direction.

In accordance with a further development, a group of openings is arranged in such a way that it directly borders on an adjacent group over a portion of its length in the web travel direction. This makes it possible to reduce the structural width of the steam blower box.

As is the case in the first embodiment, separate channels are formed so that the air is deflected in a controlled manner in a certain direction. Turbulences are substantially prevented.

It is also advantageous to provide at least one area without steam outlet openings within a group of openings.

In accordance with a further development of the invention, the borders of the respective groups are formed by continuous rows of steam outlet openings, so that the entry of air and the attendant turbulences are prevented.

The total number of steam outlet openings to be provided depends especially on the quantity of steam to be applied and the web travel speed, wherein the distribution within the respective groups may be uniform or non-uniform.

Finally, the steam blower box may be divided transversely of the web travel direction into a plurality of separately controllable zones which permit the injection of different steam quantities for regulating the transverse profile. Each zones may have at least one group of steam outlet openings, so that the steam application areas coincide with the zones arranged transversely of the web.

At the borders of the regulating zones, the lateral flows of air and the resulting displacement of steam jets and an increased condensation of steam in the border area with the air may cause strips of reduced steam application. In accordance with the invention, this is prevented by arranging the zone separating walls not precisely in the web direction, but also inclined relative to the web direction, preferably in the same direction and the same extent as the borders of the steam application areas. This results in overlapping steam application areas which can compensate the described effect.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
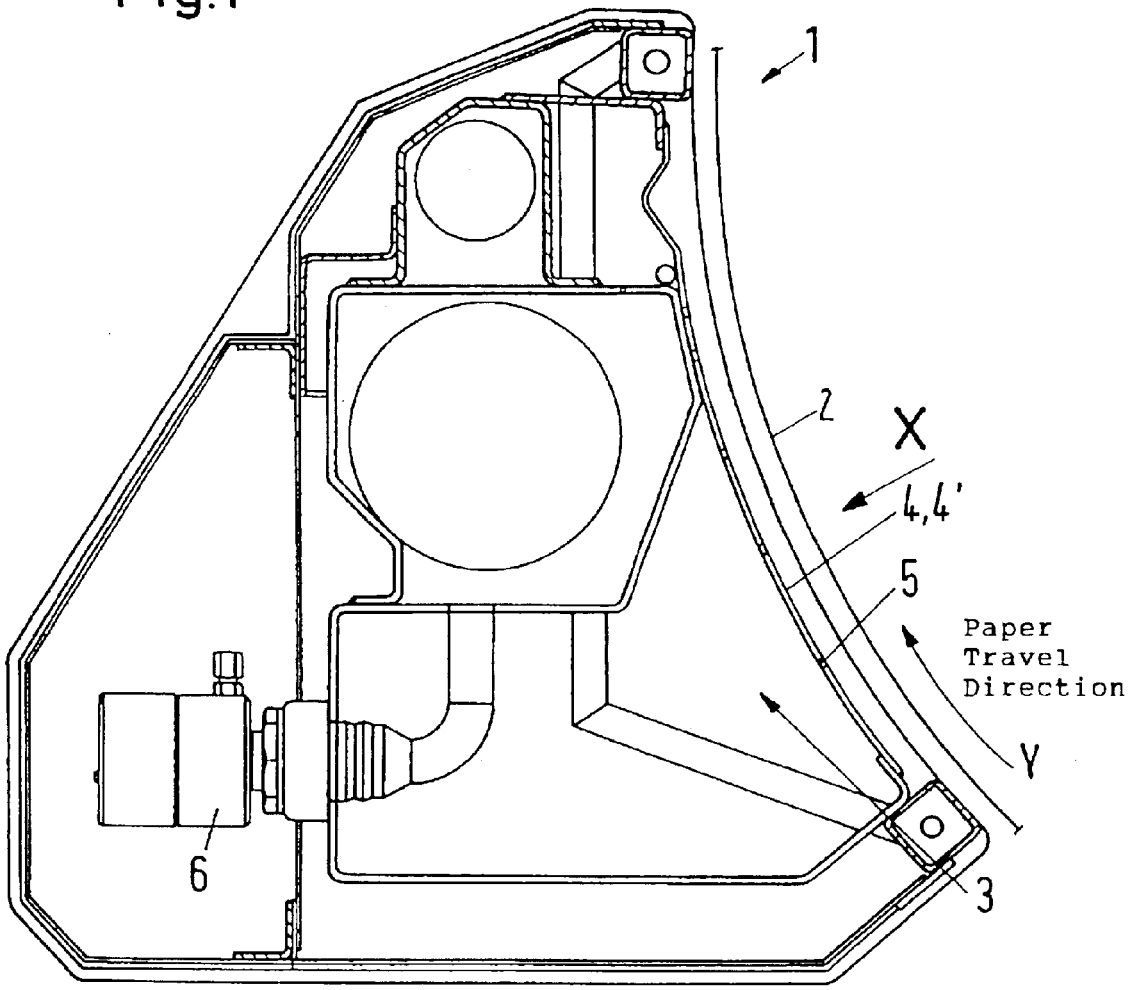
FIG. 1 is a sectional view of a steam blower box according to the present invention.

A steam blower box 1 is used, for example, for the steam application onto a material web, particularly a paper web 2, at a calendar, not shown. The paper web travels through one or more roll nips for improving the gloss and smoothness properties of the web. The web 2 is conveyed along the steam blower box 1 in the direction of the arrow Y and steam is applied to the web.

The steam blower box 1 has a steam blower chamber 3 with a housing wall 4 facing the paper web 2, wherein a plurality of steam outlet openings 5 are provided in the housing wall 4. Steam is supplied through the steam blower chamber 3 through a steam valve 6 and the steam is ejected through the steam outlet openings 5 onto the paper web 2 where the steam condensates and the temperature and the moisture of the paper web 2 is increased prior to the processing in the roll nip of the calendar. To the extent described so far, the steam blower box 1 does not differ from conventional steam blower boxes as described, for example, in DE 37 01 406 C2.

The essential difference of the steam blower box 1 as compared to the prior art resides in the configuration of the housing wall 4 which faces the paper web 2.

Figure 2:
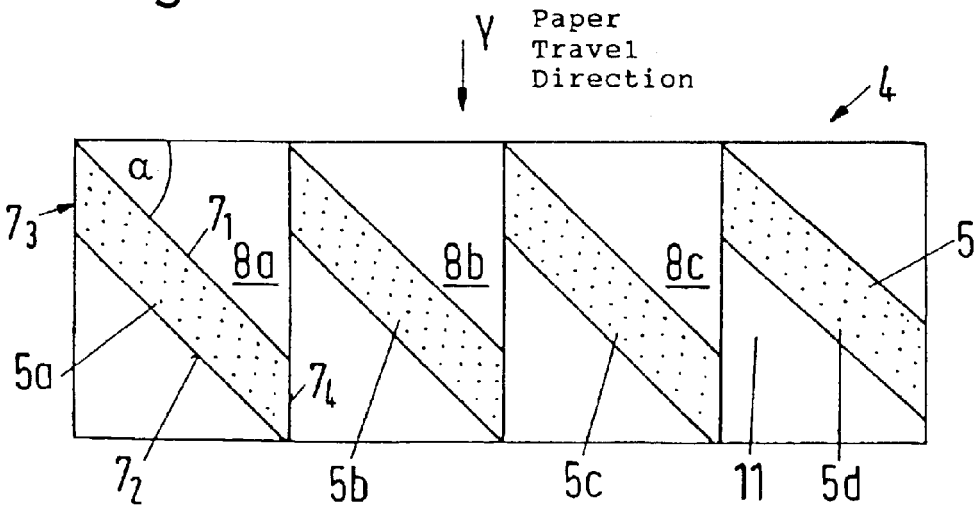
FIG. 2 is a partial view of a perforated plate of the steam blower box of FIG. 1.
Figure 3:
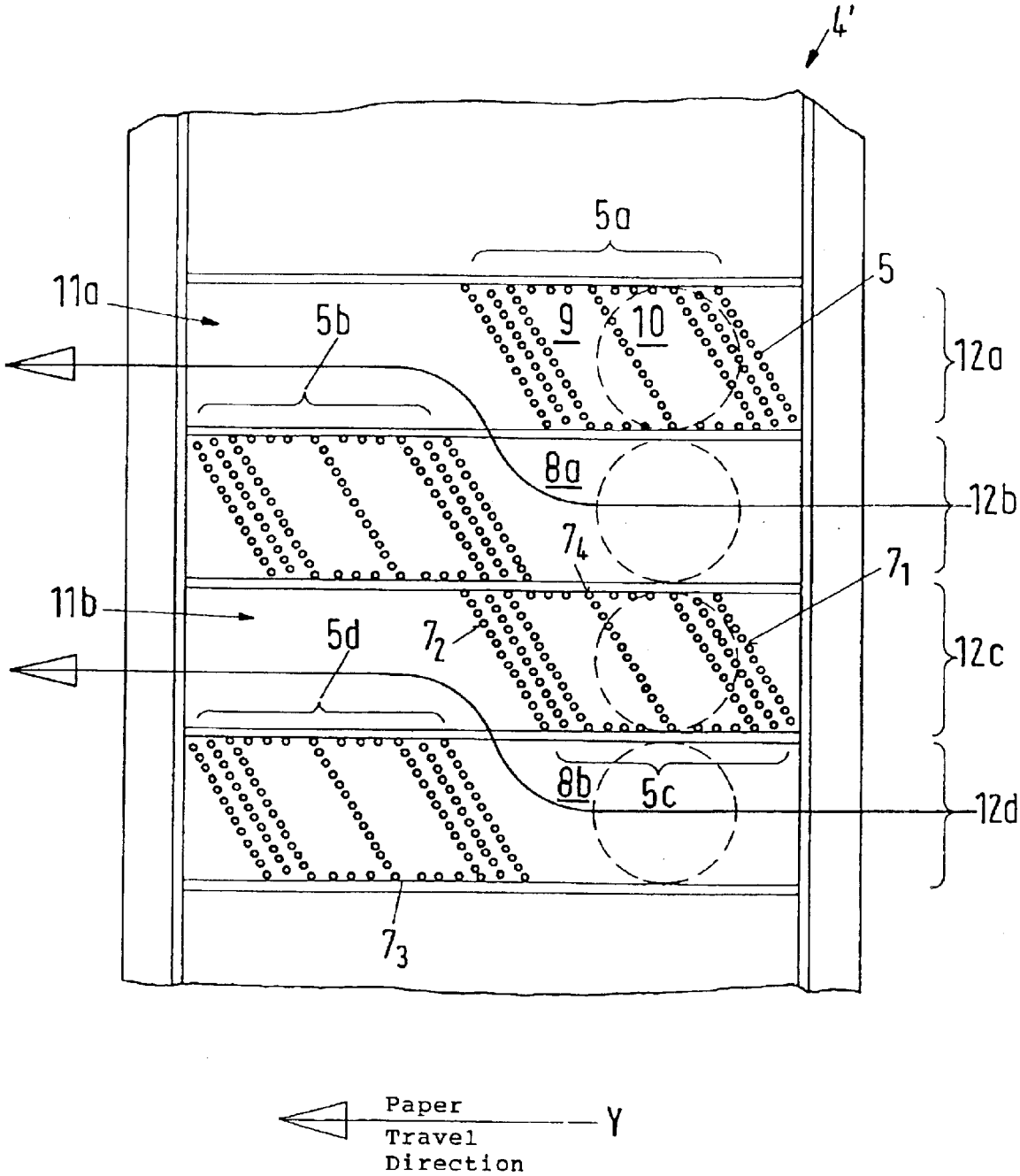
FIG. 3 is a partial view of a perforated plate according to a second embodiment of the invention.
Figure 4:
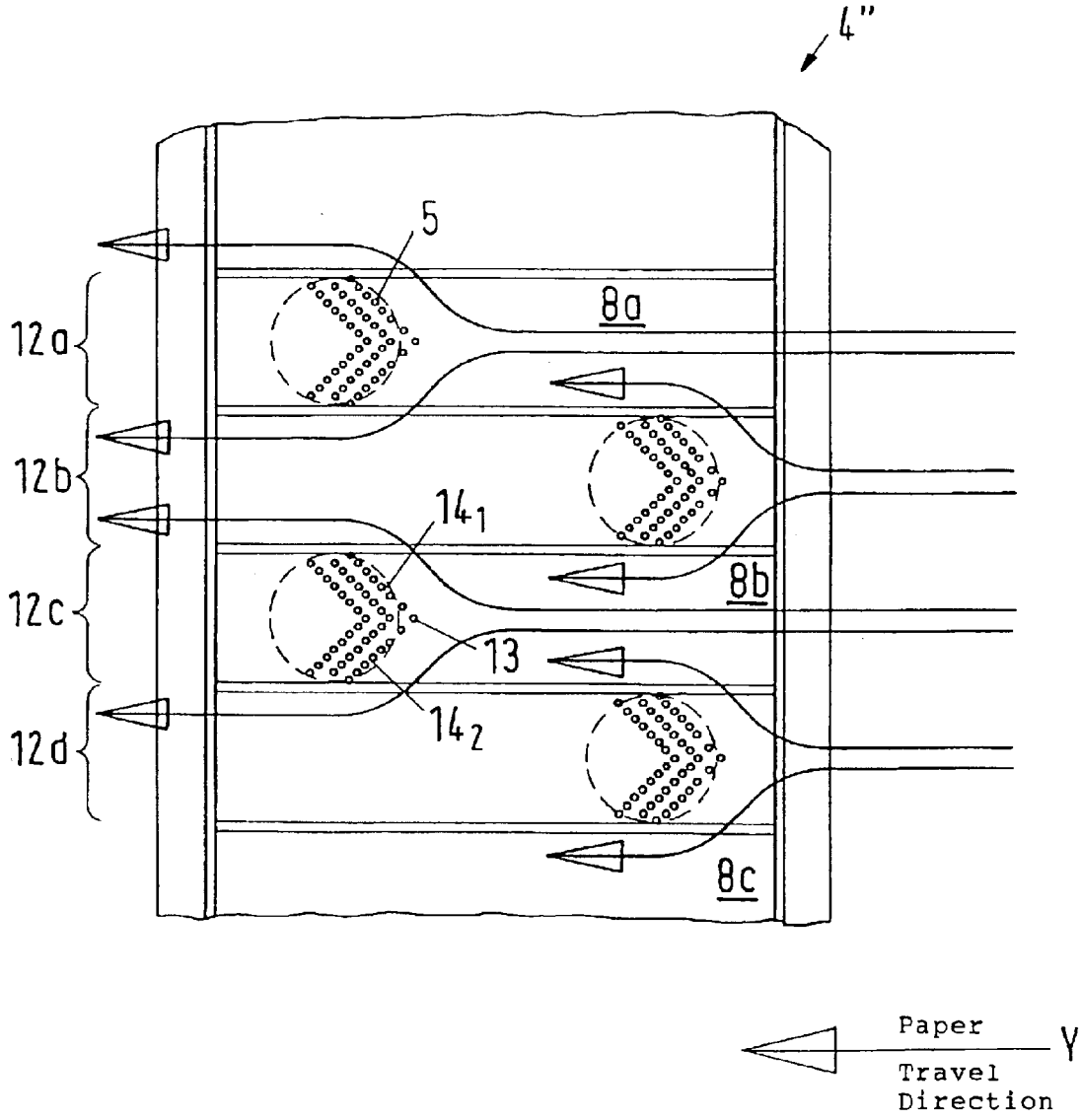
FIG. 4 is a partial view of a perforated plate according to a third embodiment of the invention.
Figure 5:
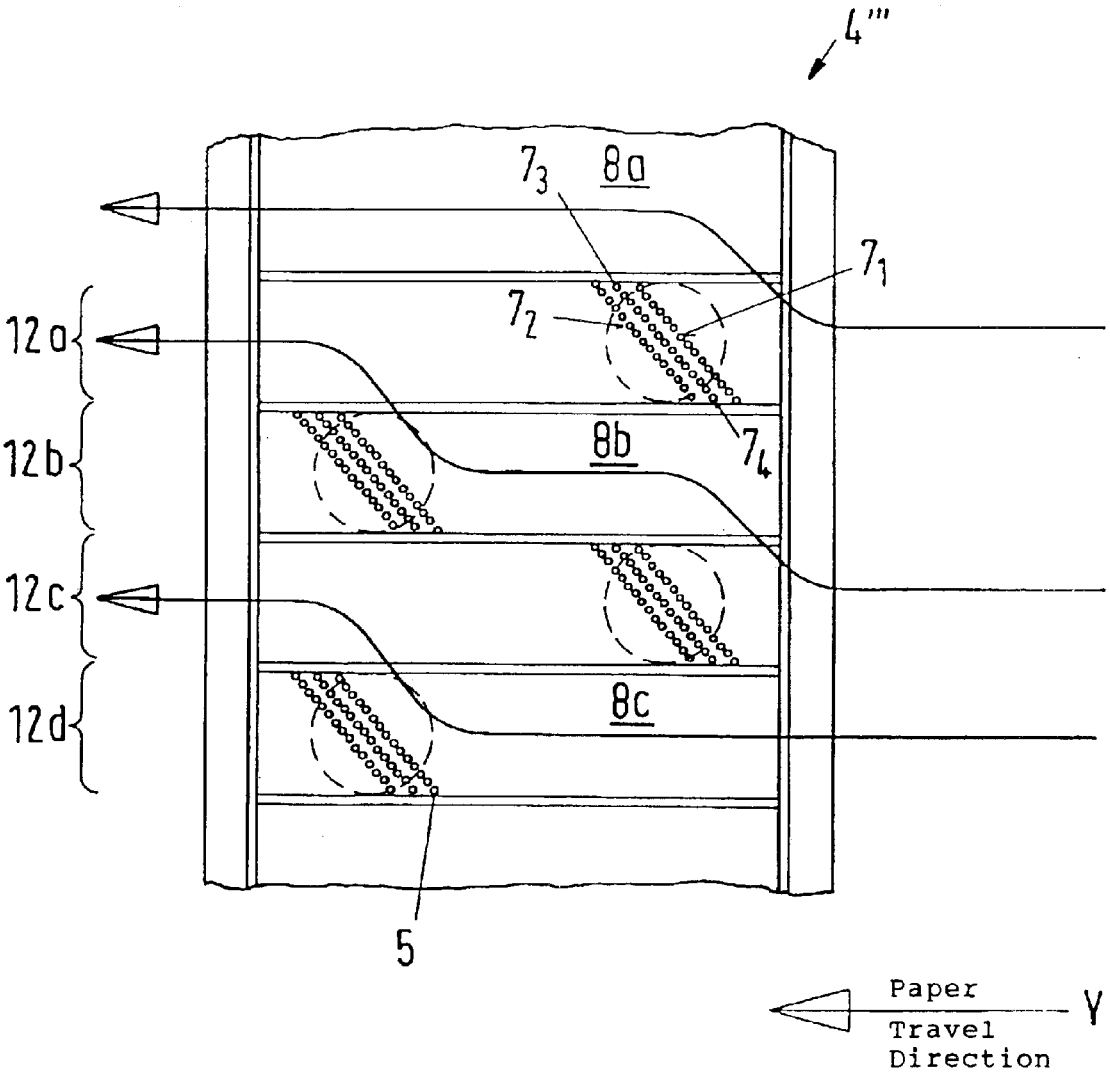
FIG. 5 is a partial view of a perforated plate according to a fourth embodiment of the invention.

The housing wall 4, 4', 4", 4''', illustrated in a partial view in FIGS. 2 through 5, is constructed as a perforated plate with the steam outlet openings 5. The steam outlet openings 5 are arranged in several groups 5*a* to 5*d*. In the illustrated embodiment, four groups are provided. In FIGS. 2, 3 and 5, the groups 5*a* to 5*d* are arranged in the form of a parallelogram. The front sides $\mathbf{7}_1$ of the groups 5*a* to 5*d* formed by steam outlet openings 5 in the web travel direction are inclined by an angle $\alpha$ relative to the web travel direction, as are the rear sides $\mathbf{7}_2$, while the adjacent lateral sides $\mathbf{7}_3$, $\mathbf{7}_4$ of the groups 5*a* to 5*d* are arranged parallel to the web travel direction. In contrast, in the embodiment illustrated in FIG. 4, the groups 5*a* to 5*d* are arranged in the form of an arrow or wedge.

The groups 5*a* to 5*d* are arranged offset relative to each other and sections 8*a* to 8*c* which are free of steam application are formed between the groups.

The steam outlet openings 5 may be arranged uniformly distributed within the individual groups 5*a* to 5*d*. Alternatively, areas 9, 10 without steam outlet openings 5 may be provided, as seen in FIG. 3, wherein the areas 9, 10 should be surrounded at all sides by at least one row of steam outlet openings 5. At the front and rear sides $7_1$, $7_2$ of the groups 5*a* to 5*d*, preferably several rows of steam outlet openings 5 should be arranged behind each other so that the necessary steam quantity can be applied.

The offset arrangement of the groups 5*a* to 5*d* forms channels 11 or 11*a* and 11*b* between the groups which deflect the air entrained by the material web 2 in a targeted manner and conduct the air past the steam application areas of groups 5*a* to 5*d*. In FIGS. 3–5, the arrows show the flow pattern of the air conducted between the perforated plate 4 and the material web 2. The deflection is reinforced by the inclined arrangement of the front sides $7_1$ of the groups 5*a* to 5*d*. To ensure that the channel cross-section remains essentially constant and that no restrictions lead to turbulences of the air, the rear sides $7_2$ of the groups 5*a* to 5*d* are inclined at a corresponding angle.

In the embodiment illustrated in FIG. 2, the groups 5*a* to 5*d* are arranged transversely of the web travel direction offset in such a way that a section 8*a*–8*c* without steam application is created between adjacent groups 5*a* to 5*d*. The front steam outlet openings 5 are arranged at an angle of about 45° inclined to the web travel direction.

In the second embodiment illustrated in FIG. 3, the deflection takes place in stages. In this case, the groups 5*a* to 5*d* are arranged offset relative to each other in the web travel direction, so that stepped sections 8*a*, 8*b* without steam application are formed through which the air is discharged. The adjacent groups 5*b* and 5*c* border each other over portions thereof, so that the air cannot pass through between these groups. In this embodiment, the front steam outlet openings 5 are arranged at an angle of about 30° inclined to the web travel direction.

In the embodiment shown in FIG. 4, the groups 5*a* to 5*d* are arranged in the form of arrows. When the air entrained by the paper web impinges on the tips 13 of the arrows, the air is divided into two air flows and is conducted past the two arrow sides $14_1$ and $14_2$. The arrow sides $14_1$ and $14_2$ are arranged so as to be directed in opposite directions and inclined by an angle of about 45° relative to the web travel direction. The sides of the arrows in the rear in the web travel direction (groups 5*a* and 5*c*) can also be steeper, for example, at an angle of 60° than the arrow sides of the front arrows (groups 5*b* and 5*d*).

In the embodiment shown in FIG. 5, the groups 5*a* to 5*d* are arranged similarly in the form of simple parallelograms, as is the case in the embodiment of FIG. 2. In contrast to FIG. 2, the groups are not arranged offset relative to each other in the web travel direction. As a result, the air can be discharged even more easily.

When the air entrained by the paper web impinges on the steam flow in the steam application area, formed by steam outlet openings 5, the retained air is deflected to the side, is conducted into the channels 1 and guided between the steam application zones, essentially without negatively affecting the steam application. The precise shape of the air channels can be varied by changing the shape and arrangements of the groups 5*a* to 5*d*. In the drawing, the groups 5*a* through 5*d* are formed as parallelograms of equal size or as arrows. However, the shapes of the groups for forming suitable channels are also conceivable, for example, wedge-shaped groups.

The steam blower box 1 may have transversely of the web travel direction zones 12*a* to 12*d* which are separately controllable, wherein each of the zones has at least one group 5*a* to 5*d* of steam outlet openings.

As a result, a moisture and/or temperature profile can be applied as desired on the paper web transversely of the travel direction. As a result of the particular configuration of steam outlet openings 5 in the perforated plate 4 according to the present invention, the air film which is conveyed by the web 2 is conducted past the steam application areas in a simple and effective manner. This means that the steam application areas are kept virtually free of air and the applied steam can condensate directly on or in the material web. Consequently, a high heat and moisture transfer onto the web is ensured. The efficiency of the steam blower box is increased accordingly.

While specific embodiments of the invention have been shown and described in detail to illustrate the inventive principles, it will be understood that the invention may be embodied otherwise without departing from such principles.

I claim:

1. A steam blower box for applying steam onto a material web travelling in a travel direction past the steam blower box, the steam blower box comprising a housing wall extending transversely of the web travel direction and facing the material web, wherein a plurality of steam outlet openings are provided in the housing wall, wherein the steam outlet openings are arranged in at least two separate groups, and wherein a section without steam application is provided at least between two adjacent groups, wherein air entrained by the material web is discharged through the section without steam application.

2. The steam blower box according to claim 1, wherein a side of a group of steam outlet openings arranged next to one another and located upstream in the strip travel direction extends inclined relative to the web travel direction.

3. The steam blower box according to claim 2, wherein a rear side of a group of steam outlet openings extends inclined relative to the web travel direction.

4. The steam blower box according to claim 3, wherein at least one of the front side and the rear side of a group of steam outlet openings extends at least partially at an angle of 30 to 60° relative to the web travel direction.

5. The steam blower box according to claim 4, wherein the angle is 45°.

6. The steam blower box according to claim 1, wherein the steam outlet openings of each group together form essentially the shape of an arrow.

7. The steam blower box according to claim 1, wherein the steam outlet openings of each group together form essentially the shape of a parallelogram.

8. The steam blower box according to claim 7, wherein lateral sides of a group of steam outlet openings extends parallel to the web travel direction.

9. The steam blower box according to claim 1, wherein adjacent groups of steam outlet openings are arranged offset relative to each other in the web travel direction.

10. The steam blower box according to claim 9, wherein transversely of the web travel direction every other group of steam outlet openings is located on the same level in the web travel direction.

11. The steam blower box according to claim 1, wherein one group of steam outlet openings is arranged directly adjacent another group of steam outlet openings over a portion of a length of the group.

12. The steam blower box according to claim 1, wherein at least one area without steam outlet openings is arranged within a group of steam outlet openings.

13. The steam blower box according to claim 12, wherein the area without steam outlet openings is surrounded at all sides thereof by at least one row of steam outlet openings.

14. The steam blower box according to claim 1, wherein the steam blower box is divided transversely of the web travel direction into a plurality of separately controllable zones, wherein each zone has at least one group with steam outlet openings.

15. The steam blower box according to claim 14, wherein separating walls are arranged between the zones, and wherein the zone separating walls extend inclined relative to the web travel direction.

* * * * *